US005768650A

United States Patent [19]

Shimamura et al.

[11] Patent Number: 5,768,650

[45] Date of Patent: Jun. 16, 1998

[54] APPARATUS FOR RECOVERING FILM CONTAINERS

[75] Inventors: Yasunobu Shimamura; Masayuki Kobayashi, both of Wakayama, Japan

[73] Assignee: Noritsu Koki Co., Ltd., Wakayama, Japan

[21] Appl. No.: 716,781

[22] Filed: Sep. 24, 1996

[30] Foreign Application Priority Data

Sep. 25, 1995 [JP] Japan ..... 7-245680

[51] Int. Cl.[6] ..... G03D 3/08; G03D 17/00

[52] U.S. Cl. ..... 396/599; 396/612; 396/613

[58] Field of Search ..... 396/612, 613, 396/568, 567, 570, 578, 615, 620, 622, 585, 599, 600, 647, 648

[56] References Cited

U.S. PATENT DOCUMENTS

| | | | |
|---|---|---|---|
| 4,341,453 | 7/1982 | Rubin | 396/568 |
| 4,363,548 | 12/1982 | Oberhoffner et al. | 396/568 |
| 5,212,512 | 5/1993 | Shiota | 396/612 |
| 5,231,439 | 7/1993 | Takahashi et al. | 396/620 |
| 5,235,369 | 8/1993 | Nakamura et al. | 396/567 |
| 5,373,338 | 12/1994 | Yamaguchi et al. | 396/620 |
| 5,426,481 | 6/1995 | Slater et al. | 396/568 |

FOREIGN PATENT DOCUMENTS

| | | | |
|---|---|---|---|
| 1542653 | 10/1968 | France . | |
| 1202411 | 8/1970 | United Kingdom | 396/916 |
| 2265992 | 10/1993 | United Kingdom . | |

*Primary Examiner*—D. Rutledge
*Attorney, Agent, or Firm*—Felfe & Lynch

[57] ABSTRACT

An apparatus for recovering film containers is disclosed. The apparatus includes a separating device for withdrawing a film stored in a wound state within a film container held at a holding portion from the film container and then separating the film from the film container and a recovering section for recovering into a collecting section the film container from which the film has been separated. According to the spirit of the invention, the recovering section includes a classifying device for classifying the film container according to the type and a plurality of collecting sections for collecting a plurality of film containers type-classified by the classifying device separately from each other according to the type.

15 Claims, 6 Drawing Sheets

51
50
8
9
2
55

APPARATUS FOR RECOVERING FILM CONTAINERS

BACKGROUND OF THE INVENTION

1. Field of the Invention

The present invention relates to an apparatus for recovering film containers, the apparatus including separating means for withdrawing a film stored in a wound state within a film container held at a holding portion from the container and then separating the film from the film container and recovering means for recovering into a collecting unit the film container from which the film has been separated.

2. Description of the Related Art

According to a conventional apparatus for recovering film containers, all the film containers from which the films have been separated by the separating means are recovered together in a mixed state into a common collecting unit.

On the other hand, there exist a variety of types of film containers containing various kinds of films. Then, when the films are separated from these containers, the apparatus would recover these film containers of different types altogether in a common collecting unit. However, some of these film containers are of a reusable type while others are of a non-reusable or disposable type. Therefore, there arises the necessity of classifying later these containers according to the type.

SUMMARY OF THE INVENTION

The present invention addresses to the above-described state of the art. A primary object of the invention is to provide an improved apparatus capable of recovering the various types of film containers in a classified state in an efficient manner.

For accomplishing the above-noted object, an apparatus for recovering film containers, according to one aspect of the the present invention, comprises:

separating means for withdrawing a film stored in a wound state within a film container held at a holding portion from the film container and then separating the film from the film container; and recovering means for recovering into a collecting section the film container from which the film has been separated;

wherein the recovering means includes, classifying means for classifying the film container according to the type, and a plurality of collecting sections for collecting a plurality of film containers type-classified by the classifying means separately from each other according to the type.

With the above construction, the film containers from which the films have been separated may be individually recovered in the plural collecting sections with the containers being classified, i.e. separated according to the type.

Therefore, the recovery of the various types of film containers may be effected in a type-classified state and in an efficient manner.

According to a further aspect of the present invention, the apparatus further comprises: determining means for determining the type of the film container; and control means for controlling the classifying means. In this case, the classifying operation of various types of film containers may be effected with higher accuracy.

According to a still further aspect of the invention, the determining means determines the type of film container by detecting a width of the film which has been withdrawn from the film container. This construction allows easier type determination of the film container, in comparison with an alternatively conceivable construction in which the determination is made by reading a type-denoting bar code which is provided in the periphery of the film container.

According to a still further aspect of the invention, the separating means causes the film-separated film container to be gravity-chuted to the classifying means. This provides an advantage of facilitating a construction needed for transporting the film container to the classifying means.

According to a still further aspect of the invention, the classifying means effects the type-classification of the film containers by changing chuting passages of the film-separated film container extending from the separating means to the respective collecting sections according to the type of each film container. This provides an advantage of allowing efficient type-classification of the film container being chuted and another advantage of facilitating a construction needed for transporting the classified film container to a corresponding collecting section.

According to a still further aspect of the invention, the plurality of collecting sections are disposed vertically relative to each other. This provides an advantage of minimizing space needed for installing this film container recovering apparatus.

According to a still further aspect of the invention, the classifying means is capable of classifying the film containers between a disposable type film container and a reusable type film container. With this, such reusable type film containers may be utilized usefully.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of an apparatus for recovering film containers according to the invention will now described in details with reference to the accompanying drawings.

Figure 1:
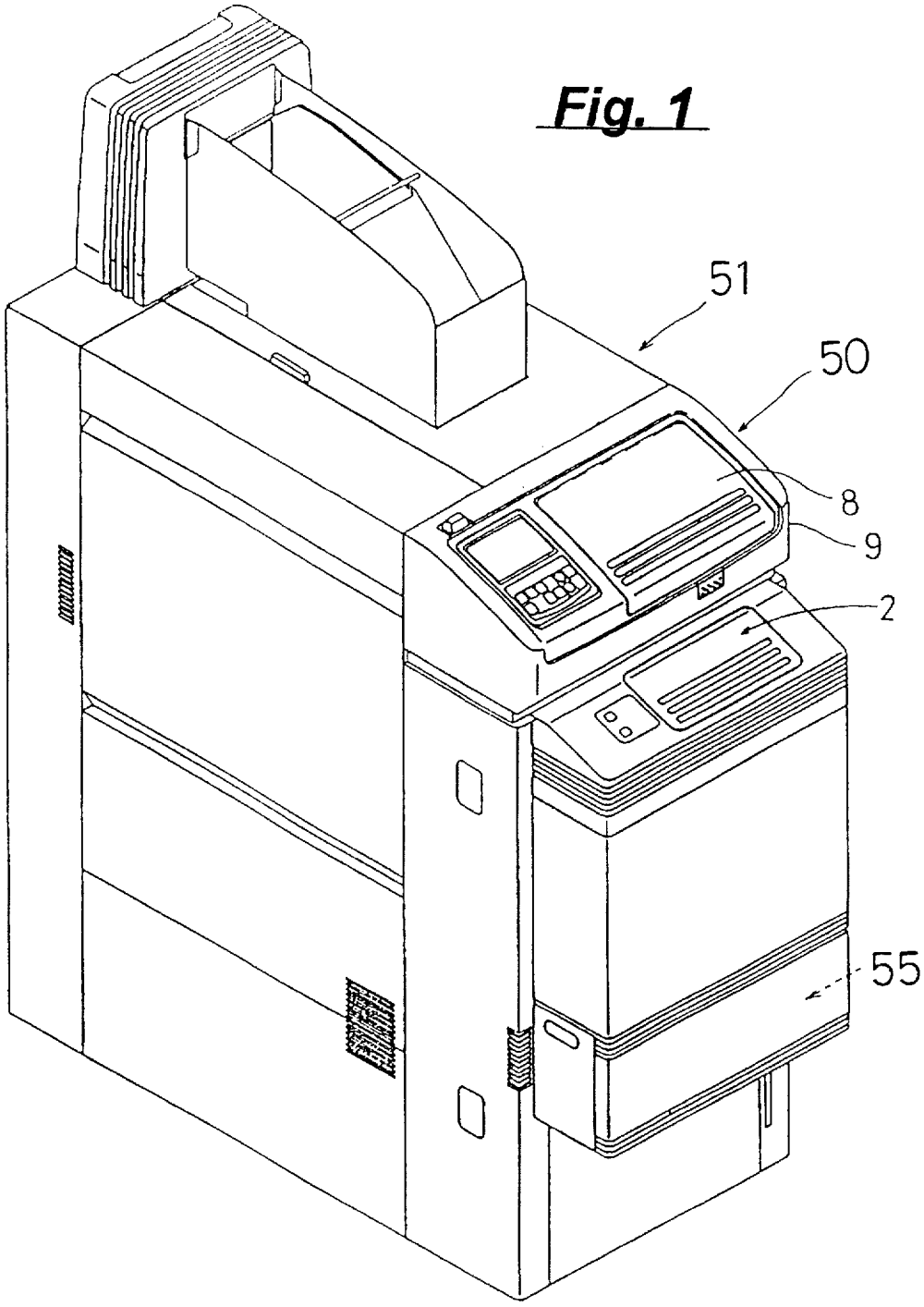
FIG. 1 is a perspective view of a film feeding apparatus.
Figure 2:
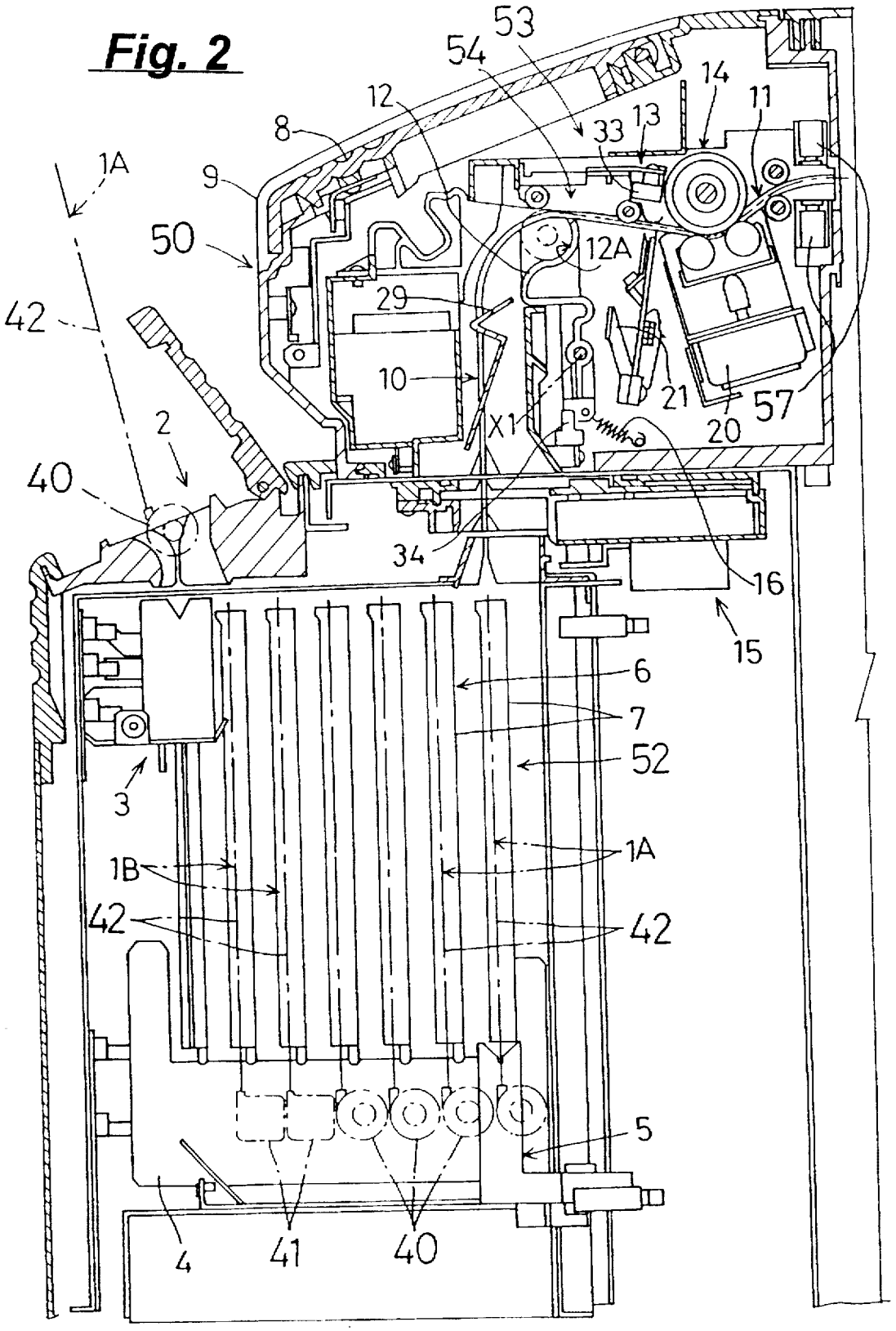
FIG. 2 is a side view in section showing the inside of the film feeding apparatus.
Figure 3:
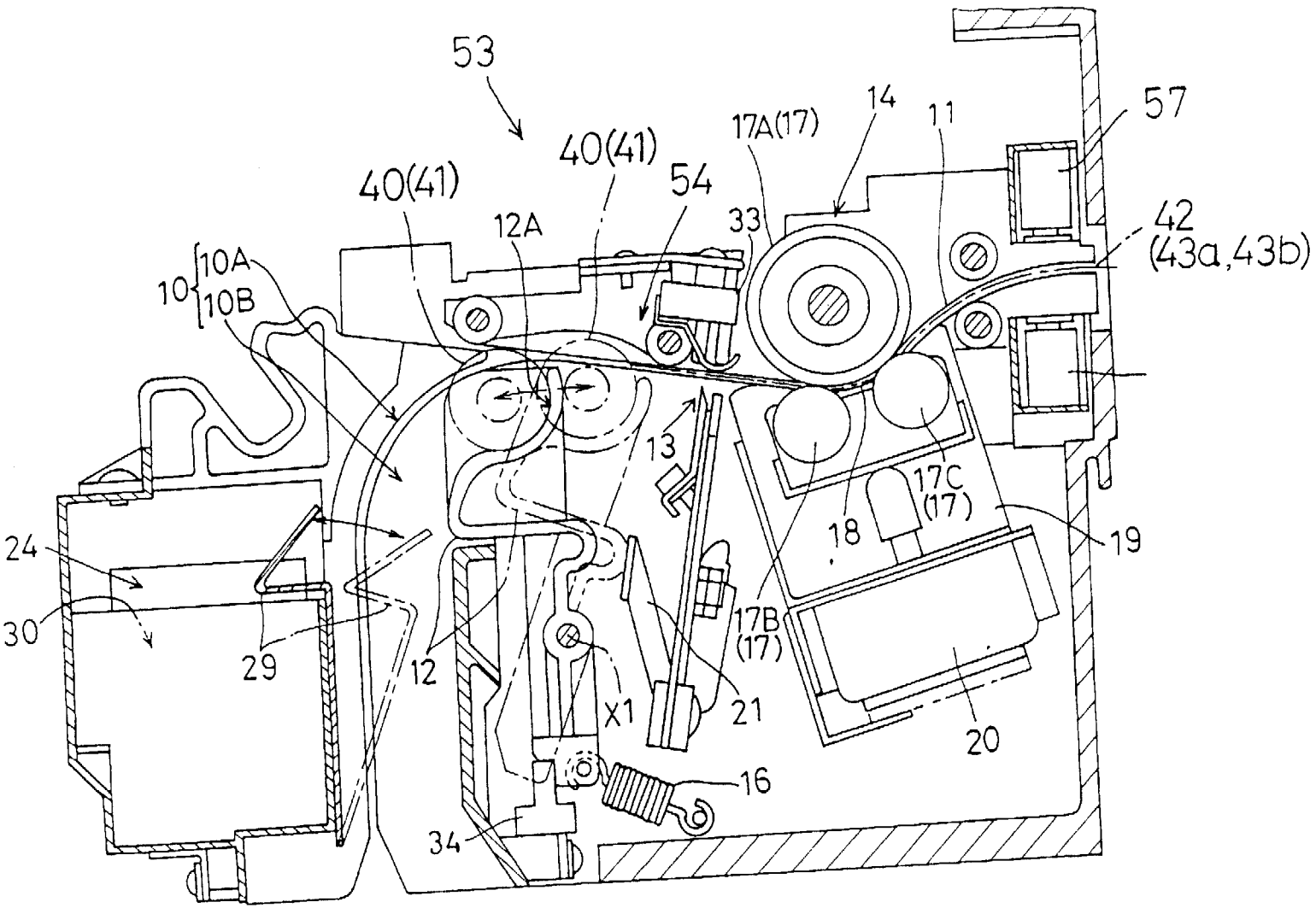
FIG. 3 is an enlarged side view showing major portions of the inside of the film feeding apparatus.

FIGS. 1, 2 and 3 a film feeding apparatus 50 for withdrawing films 43*a*, 43*b* respectively stored in a wound state within either a film patrone 40 as a disposable type film container or a film cartridge 41 as a reusable type film and then feeding these films to a developing section 51. This film feeding apparatus 50 includes a film loading section 52 into which the plurality of films 43*a*, 43*b* stored in the patrones 40 or cartridges 41 are loaded, and a film feeding section 53 for feeding the films 43*a*, 43*b* sent one after another from the film loading section 52 to the developing section 51. The film feeding section 53 includes a separating unit 54 acting as a separating means for withdrawing the films 43*a*, 43*b* wound and stored within the patrone 40 or the cartridge 41 and then separating the films 43*a*, 43*b* from the patrone 40 or the cartridge 41. Further, there is provided a recovering section 56 as a recovering means for recovering the patrone 40 and the cartridge 41, from which the films 43*a*, 43*b* have been separated, into a recovering section 55. These components mentioned above together constitute a film container recovering apparatus to which this invention relates.

Figure 7:
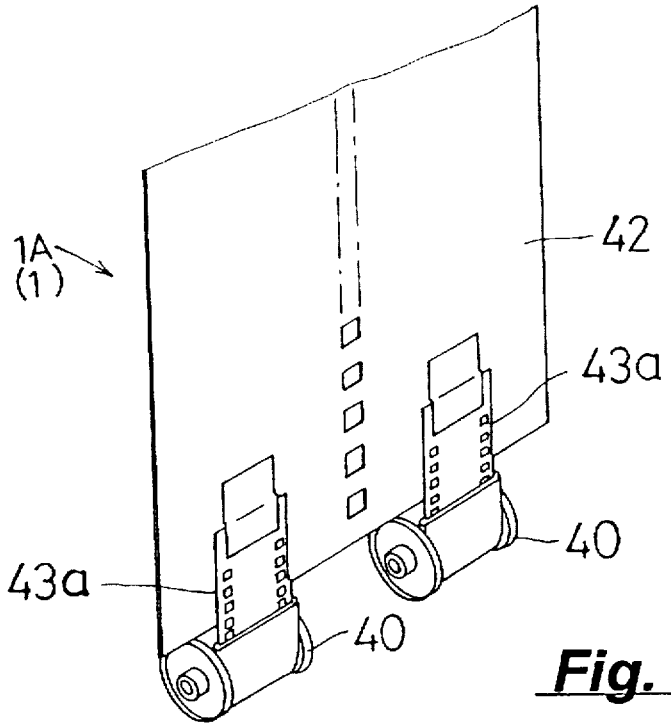
FIG. 7 is a perspective view of a film splicing assembly.
Figure 8:
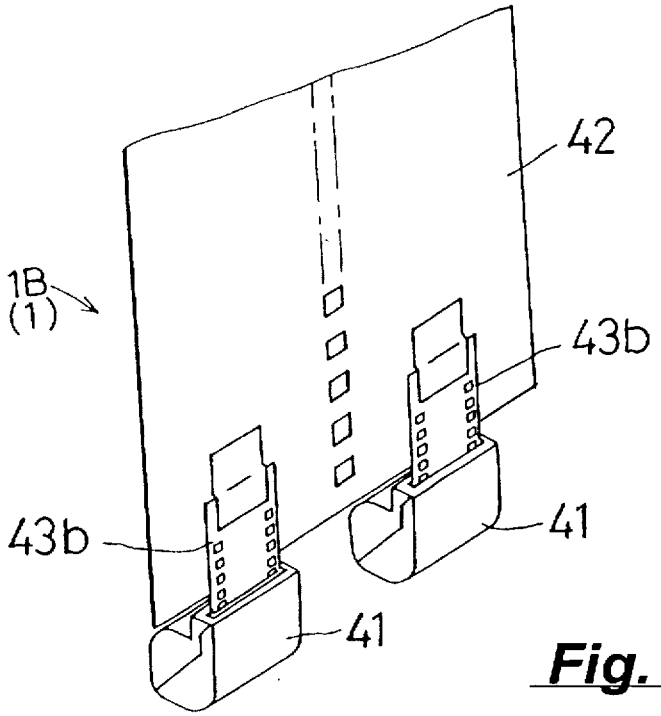
FIG. 8 is a further perspective view of the film splicing assembly.

Within the patrone 40, the film 43*a* having an approximate width of 35 mm is stored in a wound state with a rear end thereof with respect to the withdrawing direction being fixed inside the patrone 40. Whereas, within the cartridge 41, the further type of film 43*b* having an approximate width of 24 mm is stored in a wound state with a rear end of the film being completely withdrawable from the cartridge 41 in association with the withdrawal operation of the film therefrom. Further, as shown in FIGS. 7 and 8, with respect to two of these patrones 40 or cartridges 41 as one group, the leading ends of the two rolls of films withdrawn from these patrones 40 or cartridges 41 are spliced with a single strip of leader 42, thereby to constitute together a film splicing assembly 1A, 1B. Then, a plurality of these film splicing assemblies 1A, 1B are loaded into the film loading section 52.

In the case of the film 43*b* wound and stored within the cartridge 41 as the reusable type film container, the film 43*b* is withdrawn from the cartridge 41 and then subjected to such operations including a developing operation and a printing operation. Thereafter, this film 43*b* is re-wound into the cartridge 41 for a reuse thereof.

Incidentally, in the instant embodiment, the single leader 42 joins two patrones 40 or cartridges 41 as a group. Instead, only one patrone 40 or cartridge 41 may be joined to the leader 42.

The film loading section 52 includes a loading opening 2 into which the film splicing assemblies 1A, 1B are set with the leaders 42 thereof being oriented upward, a downward transporting device 3 for downwardly feeding the set film splicing assemblies 1A, 1B inside this film loading section 52, a lateral transporting device 4 for laterally transporting the film splicing assemblies 1A, 1B fed by the downward transporting device 3 inside the film loading section 52, and an upper transporting device 5 for upwardly transporting the film splicing assemblies 1A, 1B, which have been transported laterally by the lateral transporting device 4, one after another from the side of the leader 42 thereof to the film feeding section 53.

Referring to the lateral transporting device 4, a pair of bar conveyers 6 each defining an elongate slop are disposed at opposed sides within the film loading section 52. And, a plurality of pairs of these bar conveyers 6 are equi-distantly mounted on a conveyer chain. In operation, while the film splicing assembly 1A, 1B set at the loading opening 2 is being downwardly fed by the downward transporting device 3, opposed side ends of its leader 42 are inserted and engaged into the elongate slots of the opposed guide bars 7, whereby the film splicing assembly 1A, 1B is vertically supported by the guide bars 7 with its leader 42 being oriented upwards. Under this condition, the lateral transporting device 4 laterally transports the assembly to the upward transporting device 5 by turning of the bar conveyer 6 about a vertical axis.

Inside a case 9 having a vertically openable lid 8, the film feeding section 53 includes a splicing assembly passage 10 in which the film splicing assembly 1A, 1B fed by the upward transporting device 5 is caused to pass with the leader 42 thereof being at the forward end, a slit-like film passage 11 in which the leader 42 together with the films 43*a*, 43*b* is caused to pass toward the developing section 51, a holder 12 as a holding portion for holding the patrone 40 or cartridge 41 by holding a concave face portion 12A thereof, a cutter device 13 for cutting the rear end of the film 43*a* when this film 43*a* stored within the patrone 40 is to be fed to the developing section 51, a pinch transporting device 14 for pinching the leader 42 and the films 43*a*, 43*b* having passed through the splicing assembly passage 10 into the film passage 11 and transporting these toward the developing section 51, and a shutter device 15 capable of selectively opening and closing an entrance opening to the splicing assembly passage 10.

The splicing assembly passage 10 includes a slit-like leader passage 10A through which the leader 42 passes and a container passage 10B through which the patrone 40 or cartridge 41 storing the film 43*a* or 43*b* passes. And, the leader passage 10A is continuously communicated with the film passage 11. Within this film passage 11, there are provided a passage-detecting sensor 33 using a limit switch or the like for detecting passage or non-passage of the leading end of the leader 42 and a film-width detecting photo sensor 57 for distinguishing between the wide film 43*a* which was stored within the patrone 40 and the narrow film 43*b* which was stored with the cartridge 41.

The concave face portion 12A of the holder 12 is pivotable about a horizontal axis X1 along the container passage 10B, and a coil spring 16 is provided for urging the concave face portion 12A to the upstream side of the container passage 10B.

The pinch transporting device 14 includes two roller pairs 17 each pair including a drive roller 17A about which the films 43*a*, 43*b* or its leader 42 is entrained in an arcuate form, and two free rollers 17B, 17C for pinching the films 43*a*, 43*b* or its leader 42 entrained about the drive roller 17A in cooperation with the drive roller 17A at two separate positions along a pinch transport passage 18, with the two roller pairs 17 being disposed side by side in the direction of the width of the film passage 11 in the moving path of the two rolls of films 43*a*, 43*b* fed from the patrones 40 or cartridges 41. Further, a solenoid device 20 is provided for switching over the roller pairs 17 between a pinching state and a pinching released state by moving a frame 19 mounting the free rollers 17B, 17C thereon to and away from the drive rollers 17A.

In operation, when the leading end of the leader 42 of the film splicing assembly 1A, 1B fed by the upward transporting device 5 is caused to pass through the splicing assembly passage 10 into the film passage 11. Then, when this is further moved to pass between the drive rollers 17A and the free rollers 17B, 17C, this passage is detected by the passage detecting sensor 33. Upon this detection, the roller pairs 17 are switched over to the pinching state to pinch the leader 42 and also the drive rollers 17A are driven to feed the leader 42 toward the developing section 51.

With the feeding of the leader 42 by the drive rollers 17A toward the developing section 51, the patrones 40 or the cartridges 41 are pulled and moved along the container passage 10B. Then, this movement is checked when these patrones 40 or the cartridges 41 come to be held by the holder 12. Thereafter, the films 43*a*, 43*b* wound and stored within these patrones 40 or cartridges 41 are withdrawn therefrom.

In case the patrones 40 are held by the holder 12, as the rear ends of their films 43*a* are fixed within the respective patrones 40, with completion of the withdrawal of the films 43*a* therefrom, the holder 12 is pivoted against the urging force of the coil spring 16 until this holder 12 come into abutment against the stopper 21 towards the terminal end of the container passage 10B. Then, as the holder 12 turns ON the photo sensor 34, the cutter device 13 is activated to cut off the rear ends of the films 43*a*, whereby the patrones 40 and the films 43*a* are separated from each other, and the films 43*a* are fed further toward the developing section 51. With the cutting of the films 43*a*, the holder 12 is returned to its original position under the urging force of the coil spring 16 and also the patrones 40 are allowed to chute off the holder 12.

On the other hand, in case the cartridges 41 are held by the holder 12, the holder 12 does not turn ON the photo sensor 34, and the rear ends of the films 43*b* are allowed to be completely withdrawn from the respective cartridges 41 to be fed toward the developing section 51. Thereafter, by means of an unillustrated discharging mechanism, the cartridges 41 are forcibly discharged from the holder 12 to chute off the same. The empty patrones 40 or cartridges 41 from which the films 43*a* or 43*b* have been withdrawn are allowed to chute off the holder 12 to be collected into the recovering section 55.

Accordingly, in case the films 43*a* stored in the patrones 40 are fed toward the developing unit 51, the holder 12, the pinch transporting device 14 and the cutter device 13 together constitute the separating unit 54 for withdrawing the film 43*a* from the patrone 40 in which the film is stored in a wound state and then separating the film 43*a* from this patrone 40. On the other hand, in case the films 43*b* stored in the cartridges 41 are fed toward the developing unit 51, the holder 12 and the pinch transporting device 14 together constitute the separating section 54 for withdrawing the film 43*b* from the cartridge 41 in which the film is stored in a wound state and then separating the film 43*b* from this cartridge 41.

Figure 4:
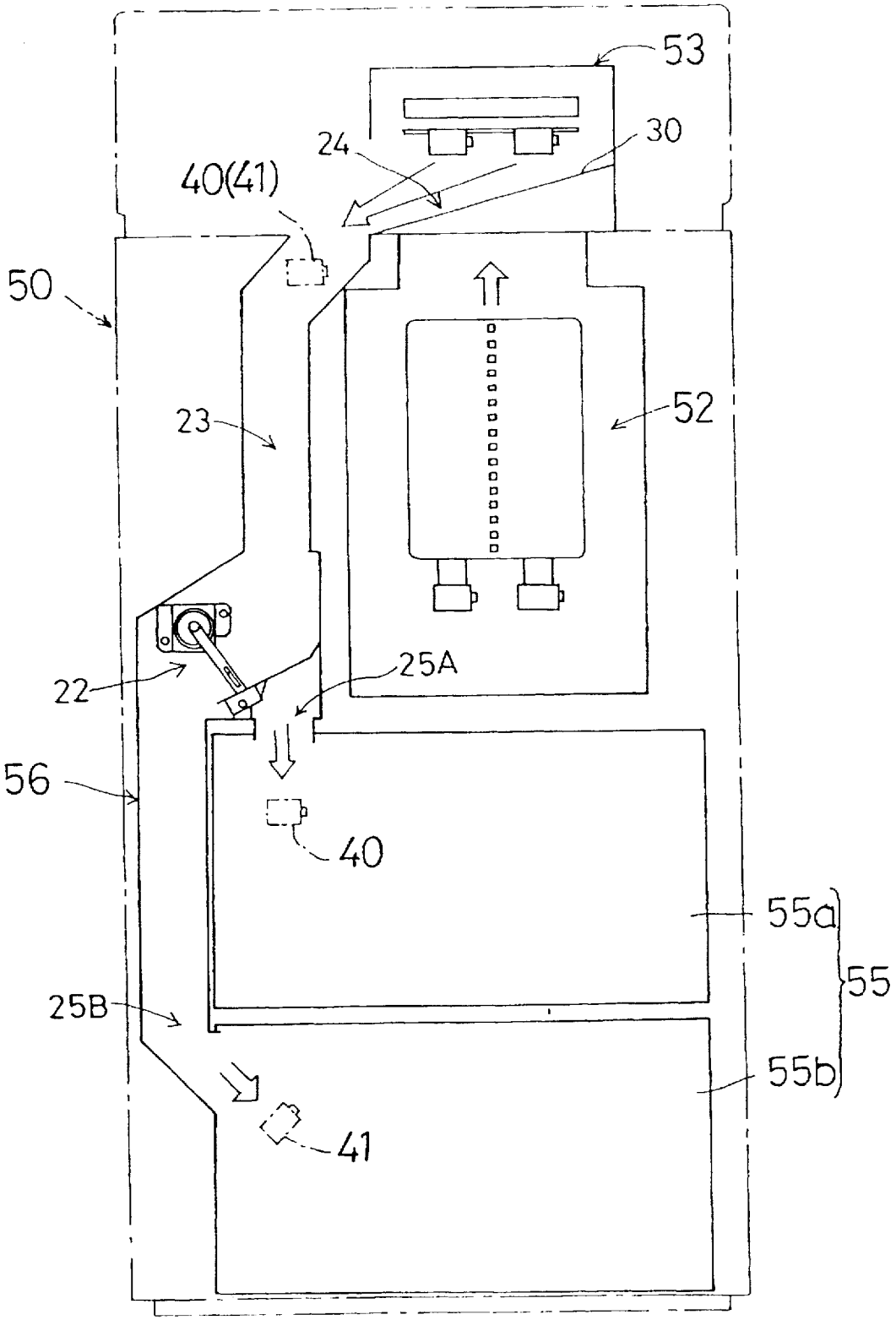
FIG. 4 is a schematic side view showing a film-cartridge recovering section.
Figure 6:
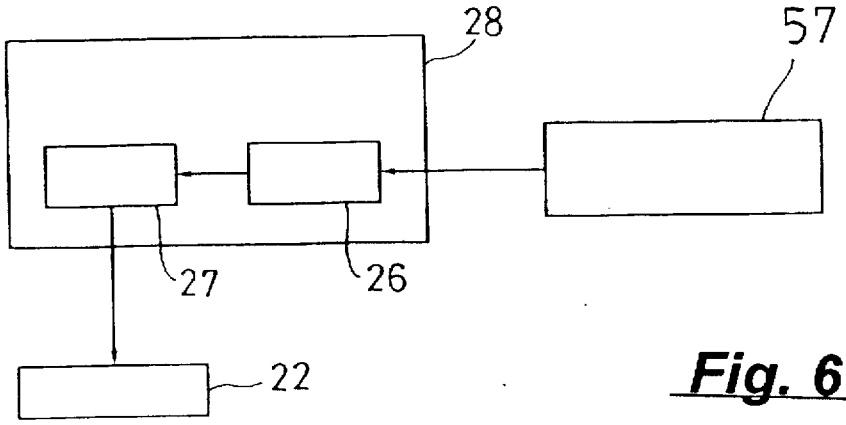
FIG. 6 is a control block diagram.

Referring now to FIG. 4, the recovering section 55 includes a classifying device 22 acting as a classifying means for distinguishing between the patrone 40 and the cartridge 41, a common chute passage 23 for allowing the patrone 40 or the cartridge 41 separated at the separating section 54 to gravity-chute to the classifying device 22, a guide portion 24 for guiding the patrone 40 or the cartridge 41 separated and dropped from the separating section 54 toward an entrance opening of the common chute passage 23, two collecting sections 55*a*, 55*b* disposed one above the other for separately collecting the patrones 40 and the cartridges 41 classified by the classifying device 22, and recovering chute passages 25A, 25B for allowing separate chuting of the patrones 40 and cartridges 41 classified by the classifying device 22 into the two respective collecting sections 55*a*, 55*b*. As shown in FIG. 6, the recovering section 55 further includes a determining unit 26 acting as a determining means for determining the type of the film container, i.e. whether the container is a patrone 40 or a cartridge 41, based upon the result of detection by a film-width detecting photo sensor 57 and a controller 28 having a control unit 27 acting as a control means for operating the classifying device 22 based on the determination made by the determining unit 26.

The guide portion 24 includes a discharge guide plate 29 for receiving the patrone 40 or cartridge 41 chuted from the holder 12 and then discharging it to the outside of the container passage 10B, and a chute 30 for allowing the patrone 40 or cartridge 41 discharged by the discharge guide plate 29 to be donwwardly slided toward the entrance opening of the common chute passage 23. The discharge guide plate 29 is pivotally urged to project into the container passage 10B. In operation, when the patrone 40 or cartridge 41 before separation of the film therefrom on its way to the holder 12 comes to press the discharge guide plate 29 from the under, the discharge guide plate 29 is retracted toward the chute 30 against the urging force described supra to allow the movement of the patrone 40 or cartridge 41 toward the holder 12. Then, after passage of the patrone 40 or cartridge 41, the guide plate 29 is urgedly pivoted to project into the container passage 10B, so as to discharge the patrone 40 or cartridge 41 separated at the separating section 54 and gravity-chuted toward the chute 30.

Figure 5:
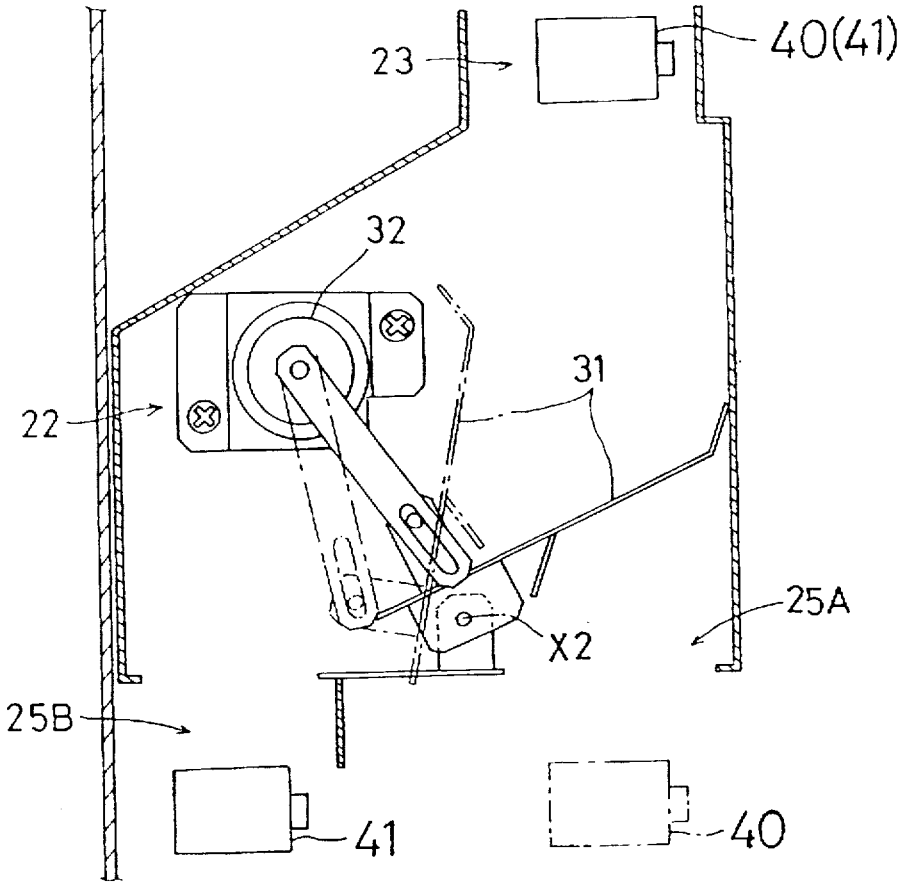
FIG. 5 is an enlarged side view of a classifying device.

Referring to FIG. 5, the classifying device 22 includes an opening/closing guide plate 31 and a rotary solenoid 32. The opening/closing guide plate 31 is disposed at a branching area between the first recovering chute passage 25A extending to the first collecting section 55*a* adapted for collecting the patrones 40 therein and the second recovering chute passage 25B extending to the second collecting section 55*b* adapted for collecting the cartridges 41 therein. And, this guide plate 31 is switchably pivotable between a first pivotal position where the plate 31 opens up the entrance opening of the first recovering chute passage 25A and closes the entrance opening of the second recovering chute passage 25B and a second pivotal position where the plate 31 closes the entrance opening of the first recovering chute passage 25A and opens up the entrance opening of the second recovering chute passage 25B. The rotary solenoid 32 drivably pivots the guide plate 31 between these first and second pivotal positions about a horizontal axis X2. With these operations, the classifying device 22 classifies the film containers, i.e. film patrones 40 and cartridges 41 according to the type by switching over the chuting passage of the separated patrones 40 and cartridges 41 from the separating means 54 to the first and second collecting sections 55*a*, 55*b*.

The control unit 27, based on the type determination made by the determining section 26, causes the opening/closing guide plate 31 to be pivoted to the first pivotal position in case a patrone 40 is separated and chuted into the first collecting section 55*a* and causes the plate 31 to be pivoted to the second pivotal position in case a cartridge 41 is separated and chuted into the second collecting section 55*b*.

Some other embodiments of the invention will be briefly described next.

1. In the foregoing embodiment of the invention, the determining means may be alternatively constructed, such that the type determination is made based upon a detection signal issued from a micro switch which is turned ON when the film 43*a* is separated from a patrone 40.

2. The determining means may be constructed, such that the determination is made by reading a bar code provided on the film container.

3. In effecting the type determination and classification, The determining means and the classifying means may utilize the fact that the one type of film container is made of a magnetic material while the other is made of a non-magnetic material.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. An apparatus for recovering film containers, said apparatus comprising:

separating means for withdrawing a film stored in a wound state within a film container held at a holding portion of a holder from the film container and then separating the film from the film container; and recovering means for recovering the film container from which the film has been separated;

said recovering means including classifying means for classifying the film container according to a type thereof; and a plurality of collecting sections for collecting a plurality of film containers type-classified by the classifying means separately from each other according to types thereof; and said separating means causing the film-separated container to be gravity-chuted to said classifying means in operative association with completion of a separating operation in which said film container is separated from the film.

2. An apparatus as defined in claim 1, further comprising:

determining means for determining the type of the film container; and control means for controlling the classifying means.

3. An apparatus as defined in claim 2, wherein the determining means determines the type of film container by detecting a width of the film which has been withdrawn from the film container.

4. An apparatus as defined in claim 3, wherein the detection of the film width is effected by a photo sensor incorporated in a slit-like film passage through which the film is caused to pass.

5. An apparatus as defined in claim 1, wherein the classifying means effects the type-classification of the film containers by changing chuting passages of the film-separated film container extending from the separating means to the respective collecting sections according to the type of each film container.

6. An apparatus as defined in claim 1, wherein the film is withdrawn from the film container as the container is held by the holding portion and has movement thereof restricted, and upon completion of the withdrawal of the film, a cutter device is activated to cut off a rear end of the film with respect to the withdrawing direction thereof, whereby the film container and the film are separated from each other.

7. An apparatus as defined in claim 6, further comprising a sensor for detecting completion of the withdrawal of the film.

8. An apparatus as defined in claim 1, wherein the plurality of collecting sections are disposed vertically relative to each other.

9. An apparatus as defined in claim 1, wherein the classifying means is capable of classifying the film containers between a disposable type film container and a reusable type film container.

10. An apparatus as defined in claim 9, wherein said recovering means includes a common chute passage for allowing the film containers separated by the separating means to gravity-chute to the classifying means with the disposable type film containers and the reusable type film containers being separated from each other, and a guide portion for guiding the disposable and reusable film containers separated and dropped from the separating means toward an entrance opening of the common chute passage.

11. An apparatus as defined in claim 9, wherein said classifying means includes an opening/closing guide plate disposed at a branching area between a first recovering chute passage extending to a first collecting section for collecting the disposable type film containers and a second recovering chute passage extending to a second collecting section for collecting the reusable type film containers, said opening/closing guide plate being switchably pivotable between a first pivotal position where the guide plate opens up an entrance opening of the first recovering chute passage and closes an entrance opening of the second recovering chute passage and a second pivotal position where the guide plate closes the entrance opening of the first recovering chute passage and opens up the entrance opening of the second recovering chute passage.

12. An apparatus as defined in claim 9, wherein the plurality of collecting sections are disposed vertically relative to each other.

13. The apparatus according to claim 1, wherein said separating means comprises a cutter;

said holder being pivotable over a predetermined pivotal stroke against an elastic urging force in association with completion of the withdrawal of the film from the film container; and said cutter being activated when the holder has been forwardly pivoted to a terminal end of the pivotal stroke.

14. The apparatus according to claim 13, wherein said holder is pivoted back to a start of the pivoted stroke by the elastic urging force in association with the operation of the cutter separating the film container from the film, so as to cause the film holder to be gravity-chuted to the classifying means.

15. The apparatus according to claim 13, wherein a sensor is activated in association with said forward pivotal motion of said holder, responsive to which said cutter is activated.

* * * * *